United States Patent [19]

El-Haj et al.

[11] Patent Number: 5,044,993

[45] Date of Patent: Sep. 3, 1991

[54] POWER OUTLET FOR ELECTRICAL ACCESSORIES

[75] Inventors: Ali El-Haj, Bridgeport; Donald J. Mattis, Norwalk; Mark Michael, Orange, all of Conn.

[73] Assignee: Casco Products Corporation, Bridgeport, Conn.

[21] Appl. No.: 580,334

[22] Filed: Sep. 10, 1990

[51] Int. Cl.[5] ..... H01R 17/18

[52] U.S. Cl. ..... 439/668; 439/34; 29/876; 29/882

[58] Field of Search ..... 439/34, 542, 543, 617, 439/668, 682, 683, 725, 727, 729, 733, 734, 802, 918; 29/511, 876, 882

[56] References Cited

U.S. PATENT DOCUMENTS

| | | | |
|---|---|---|---|
| 3,870,857 | 3/1975 | Horwitt et al. | 219/267 |
| 3,892,944 | 7/1975 | Horwitt et al. | 219/270 |
| 3,904,848 | 9/1975 | Horwitt et al. | 219/267 |
| 4,248,494 | 2/1981 | McDonald et al. | 439/668 |
| 4,580,856 | 4/1986 | Westover et al. | 339/10 |
| 4,669,185 | 6/1987 | Westover et al. | 29/882 |
| 4,713,017 | 12/1987 | Pesapane | 439/142 |

*Primary Examiner*—Paula A. Bradley

*Attorney, Agent, or Firm*—Mitchell D. Bittman

[57] ABSTRACT

An electrical power outlet assembly having a socket formed by a one-piece, deep-drawn metal cup with an integral out-turned flange at its mouth, the cup having at its bottom a transverse end wall that is lanced to form a diametric, spade-like terminal piece. One end of the terminal piece is integral with the metal cup, and the other end is free and clear. The terminal piece is bent outward to form an outstanding spade connector. An insulating terminal block is carried in the metal cup, and has a through passage extending from its front to its rear. An electrically conductive terminal is carried by the block and extends completely through the passage. The terminal has a forward contact portion adjacent the front of the block, and a rear terminal portion extending from the rear thereof. An especially simple, one-piece socket construction is thus realizeable by virtue of the integrally formed terminal piece that is stamped from the bottom wall of the metal cup.

36 Claims, 2 Drawing Sheets

POWER OUTLET FOR ELECTRICAL ACCESSORIES

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates generally to power outlets, and more particularly to those of the type intended to be installed in motor vehicles or boats, and which typically carry low voltage d. c. Such outlets are adapted to releasably receive cooperable electrical plugs, for supplying power to accessories comprising a multitude of appliances, or in other instances, to electrical cigar lighter ignitor plugs of known design.

2. Description of the Related Art Including Information Disclosed Under 37 CFR §§1.97–1.99

For example, U.S. Pat. No. 3,870,857 discloses a prior cigar lighter assemblage having a holder in the form of a well with a transverse, apertured bottom wall, and a threaded screw shell (20) which is secured to the well and which is adapted to receive the threaded portion of a tubular clamping shell (34). The front of the well is provided with a radially-outwardly extending flange (14) which bears against the edge portion of an aperture in a dashboard or panel (16), all in the usual manner. The well is electrically grounded by suitable means, via physical contact with the dashboard or panel, which in most cases is electrically conductive and at electrical ground potential.

U.S. Patents derived from Divisional Applications based on the above identified patent also exist, as follows:

U.S. Pat. No. 3,892,944

U.S. Pat. No. 3,904,848.

The disclosures of the immediately preceding two patents are substantially the same as that of the parent case.

As another example, U.S. Pat. No. 4,713,017 discloses an electrical power receptacle of the type incorporating a well (12) in the form of a tubular plastic housing and an electrically-conductive metal shell (16) that is received in the housing. As illustrated in FIG. 3 of the patent, the housing carries a leaf spring (46) which terminates in a rearwardly extending flat electrical terminal (42). This terminal is intended to be connected to the ground side of the electrical circuit which supplies the power receptacle.

Other patents, for example, U.S. Pat. Nos. 4,580,856 and 4,669,185 show a composite clamping shell for an electrical cigar lighter incorporating an integrally-formed spade lug (42) for making electrical connection between the clamping shell and electrical ground. The cigar lighter socket per se, and igniting unit with which the shell is used are not shown in this patent.

SUMMARY OF THE INVENTION

The various devices noted above have met with considerable success in the market place, and yet efforts are still being made toward the end of arriving at improvements which increase reliability, reduce manufacturing expense, and/or simplify manufacturing and assembly procedures.

Accordingly it is an object of the present invention to provide a novel and improved well construction or socket adapted for use with an electrical accessory such as an appliance, power inverter, or other power-consuming device, which construction is extremely simple in its structure and especially economical to manufacture and produce.

A related object of the invention is to provide an improved well construction or socket as above set forth, which greatly reduces assembly time, while also reducing to an absolute minimum, the number of individual parts required.

Still another object of the invention is to provide an improved well construction or socket and method for producing the same as above characterized, wherein the well or socket can be economically fabricated as a deep-drawn shell and provided with both an integral threaded portion and an integrally-formed electrical terminal, such that the well body, screw thread and terminal are all one piece. This results in reduced manufacturing/assembly time, reduced cost, and increased reliability since there is no need to verify the integrity of the electrical path from the well body to the electrical terminal. As a consequence of being formed of conductive metal and being integral with one another, the body of the well and the terminal are always at essentially the same electrical potential.

Yet another object of the invention is to provide an improved well construction or socket, and method for producing the same in accordance with the foregoing, wherein the electrical terminal is stamped from the bottom wall of the well and bent back upon itself to thereby form a double thickness having a suitable shape for connection to a spade receptacle. Following the stamping process, the completed well can be plated, so as to resist corrosion and deterioration of both the well body and the electrical terminal thereof.

The above objects are accomplished by a well or socket for an electric accessory outlet comprising, in combination a one-piece, deep-drawn metal cup having at its mouth an integral out-turned flange constituting a bezel and having at its bottom a transverse end wall that is lanced to form a diametric, spade-like terminal piece which at one of its ends is attached to said cup, the other end of the terminal piece being free and clear. The terminal piece is bent outward to form an outstanding spade connector, and the cup has adjacent the transverse end wall, an annular barrel portion the walls of which are configured to constitute a screw thread.

The arrangement is such that an especially simple, one-piece socket construction results, comprising a cup body, an integrally-formed threaded barrel, and an integrally formed terminal for connection to a spade receptacle. Plating of the completed unit is readily accomplished by standard methods. Most or all of the fabrication can be accomplished by automated assembly equipment. The extreme simplicity of the well results in a significant economy in manufacture, which is considered to be extremely important in the automotive vehicle field, where fractions of a cent per piece are considered when making cost determinations. The cost factor is further enhanced when one considers that in a typical vehicle of the house-trailer or camper variety, there can arise the need for a multiplicity of power outlets useable with various types of appliances, as will be set forth in greater detail hereinbelow.

In addition to the socket construction just described, the invention further provides an electrical power outlet assembly, comprising a one-piece, deep-drawn metal cup having at its mouth an integral out-turned flange constituting a bezel and having at its bottom a transverse end wall that is lanced to form a diametric, spade-like terminal piece which at one of its ends is attached to the metal cup, the other end of the terminal piece being free and clear, and bent outward to form an outstanding spade connector. Adjacent the transverse end wall the metal cup has an annular barrel portion. An insulating terminal block is carried in the metal cup, and has a through opening or passage extending from its front to its rear. There is also an electrically conductive terminal carried by the insulating block and extending completely through the through passage. This electrically conductive terminal in turn has a forward contact portion adjacent the front of the insulating block, and a rear terminal portion extending from the rear of the insulating block.

The invention still further provides a method of manufacturing a socket for an electric accessory of the type comprising an electrically conductive metal cup having an out-turned flange at its mouth constituting a bezel, and having at its bottom a transverse end wall. The method comprises the steps of forming the metal cup by means of a deep-drawing process employing cooperable dies, so as to produce an annular side body portion and a bottom wall portion of the metal cup, followed by forming the out-turned flange at the mouth of the metal cup by crowning. Thereafter there is stamped from the bottom wall of the metal cup, a diametric, spade-like terminal piece which at one of its ends is attached to bottom wall of the metal cup, with the other end of the terminal piece being free and clear. Following stamping, the spade-like terminal is bent adjacent its attachment, to form an outwardly-extending spade connector, for connection to a cooperable electrical spade receptacle.

Other features and advantages will hereinafter appear.

BRIEF DESCRIPTION OF THE DRAWINGS

In the drawings, illustrating preferred embodiments of the invention.

DESCRIPTION OF THE PREFERRED EMBODIMENTS

Figure 6:
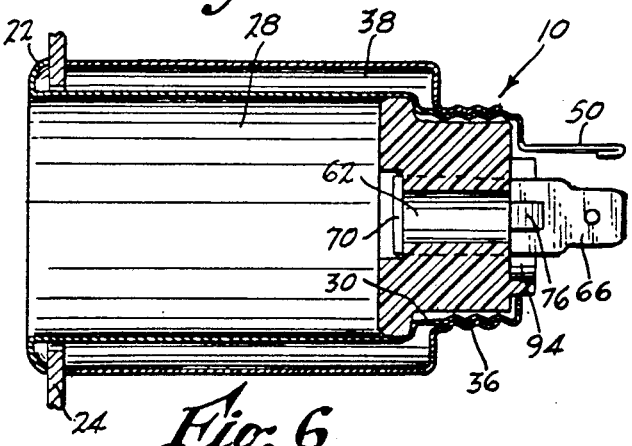
FIG. 6 is an axial section of an electrical power outlet assembly incorporating as a socket, the drawn metal cup of FIGS. 4 and 5. The assembly comprises an insulating block mounted in the metal cup, and in addition to the stamped terminal piece formed integrally with the cup, comprises an additional electrical terminal carried by the insulating block. The insulating block may be constituted of nylon or equivalent material.
Figure 7:
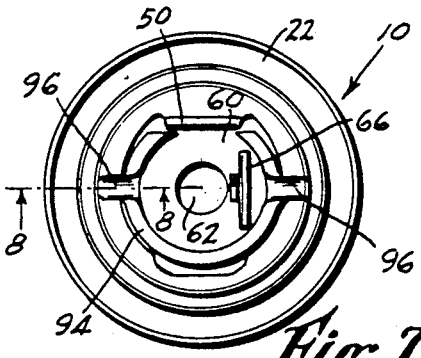
FIG. 7 is a bottom plan view of the electrical power outlet assembly of FIG. 6.

Referring first to FIGS. 6 and 7, there is illustrated a novel and improved power outlet assembly generally designated by the numeral 10, which by the present invention, comprises essentially two conductive components and one insulating component, thereby resulting in the simplest possible arrangement for carrying an electrical current between an electrical source or power supply, and an electrical load or accessory.

Figure 1:
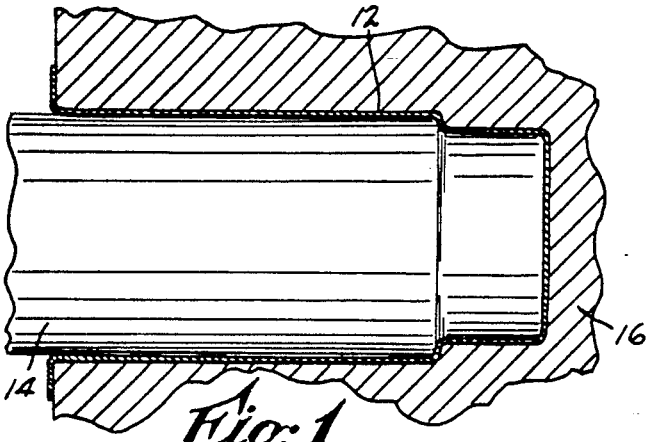
FIG. 1 is a view partly in axial section and partly in elevation, of a die for forming a deep-drawn socket in the form of a metal cup of the type employed in carrying out the present invention. The drawing step produces a metal cup having an annular wall portion, a stepped barrel portion, and a transverse bottom wall portion.
Figure 4:
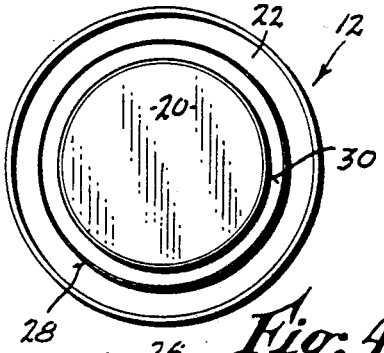
FIG. 4 is a bottom plan view of the metal cup formed by the dies of FIGS. 1-3.

Referring to FIGS. 1-7, the power outlet assembly comprises a well or socket in the form of a metal cup 12 which has been formed by a deep-drawing operation that employs male and female dies 14 and 16 respectively, FIG. 1. The cup 12 has an open mouth 18, FIG. 3, and a transverse bottom wall 20. Disposed at the mouth 18 is an integral out-turned flange 22 constituting a bezel, engageable with the panel or dashboard 24, FIG. 6, of a motor vehicle or boat. The flange 22 is formed by a crowning operation employing dies 25 and 26, respectively, as in FIG. 2. The metal cup 12 has an annular main body portion 28 and a threaded barrel portion 30, which latter is formed by rollers 32, 34 as in FIG. 3. The threaded barrel portion 30 is adapted to be engaged by a similarly threaded barrel portion 36 of a clamp shell 38 as in FIG. 6. The forward edge of the clamp shell 38 engages the rear surface of the panel 24 as shown, so as to secure the cup 12 in position when the clamp shell 38 is tightened.

Figure 15:
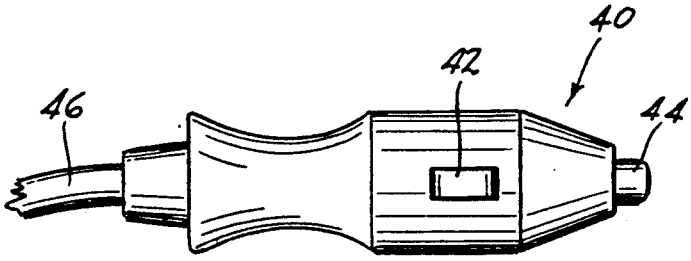
FIG. 15 is a side elevation of a male electrical plug of the type adapted for use with the electrical power outlet assembly of FIGS. 6 and 7, and of FIG. 14.

The socket or well comprising the metal cup 12 is so constituted both as a mechanical support for a male electrical plug 40, FIG. 15, of the type normally employed with automotive electrical accessories, and as an electrical conductor for engagement with spring fingers 42 on the outer surface of the electrical plug 40. The plug 40 has a center pin 44 for engagement with a "hot" terminal of the outlet assembly to be described, and an electrical lead 46 extending from one end, as shown, for connection to the particular accessory being employed with the outlet assembly.

In accordance with the present invention, there is provided in combination with the well structure described above, a novel, uniquely formed electrical terminal that is constituted as an integral part of the well structure itself. In carrying out the invention, the metal cup 12 having the rolled barrel portion 30, is operated on by a punch which blanks out part of the bottom wall 20 of the cup 12, forming a C-shaped slug 48, FIG. 16, that is scrap, and also forming a spade-like terminal 50. Each leg of the "C" can also be thought of as a segment of a circle. The area previously occupied by the slug 48 is thereby open and constitutes an access opening 52 in the bottom wall 20 of the cup 12.

Figure 3:
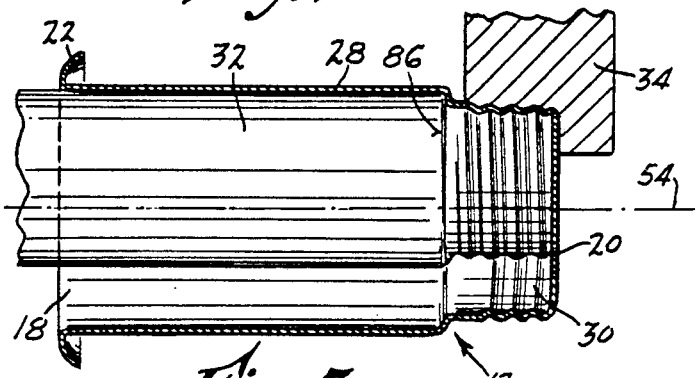
FIG. 3 is a view partly in axial section and partly in elevation, of a die for imparting a rolled thread formation to the reduced barrel portion of the cup of FIGS. 1 and 2.
Figure 2:
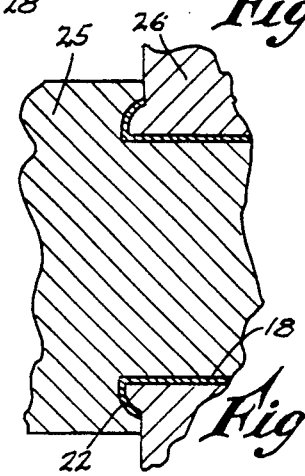
FIG. 2 is a fragmentary axial sectional view of a die for imparting to the drawn metal cup of FIG. 1, a crown at the mouth of the cup, constituting a bezel to enable the metal cup to be positioned in a hole of a panel or dashboard of a vehicle or boat.

Further by the invention the terminal 50 is bent outwardly from the cup 12 at right angles to its bottom wall 20, as in FIG. 6 so as to be substantially in alignment with the axis 54 of the cup 12, FIG. 3, after which the end of the terminal 50 is bent over upon itself so as to form a double thickness of material. Holes 56, 58, FIG. 5, formed in the terminal 50 during the stamping are preferably so located as to overlie one another when the bend is made.

The integral terminal 50 so formed thus is mechanically supported by the threaded barrel 30, being integral therewith and with the main body portion 28. As a consequence, one side of the electric circuit to the power outlet assembly 10, namely the ground side, is effectively established without resorting to multiple pieces or separate terminal/lug configurations which would have to be welded or otherwise secured in place, and wherein the integrity of such a weld connection might be questionable. It is important to note that elimination of any welding in the fabrication of these components constitutes an important cost-reduction step since it eliminates considerable manual labor as well as the need for expensive and bulky welding equipment. Also, the usual burn and fire hazards associated with welding are eliminated.

Figure 11:
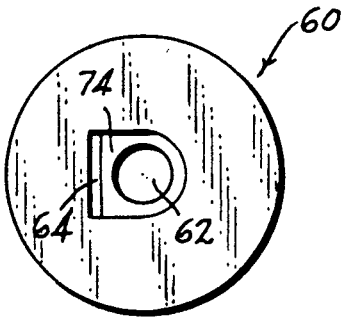
FIG. 11 is a left end elevation of the insulating block of the assembly of FIGS. 6 and 7.
Figure 13:
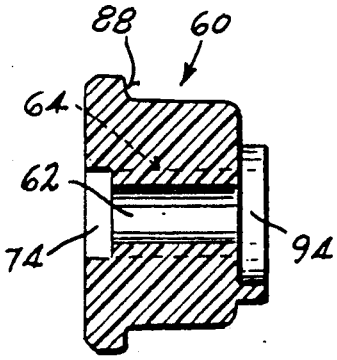
FIG. 13 is a section taken on the line 13—13 of FIG. 12.
Figure 12:
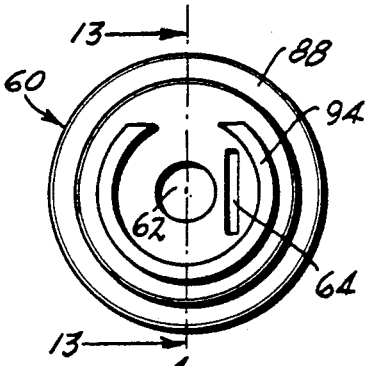
FIG. 12 is a right end elevation of the insulating block of FIG. 11.

Further in accordance with the invention there is provided a novel insulating block 60 which is mounted in the cup 12, and which is particularly illustrated in FIGS. 11–13. The insulating block 60 preferably has two through openings or passages 62 and 64 extending from the front of the block to the rear thereof. The passage 62 is centrally located with respect to the insulating block 60 and ultimately lies along the axis 54 of the cup when the insulating block is installed therein. The second through passage 64 is axially offset.

Figure 9:
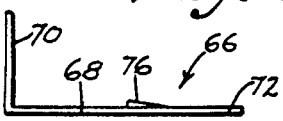
FIG. 9 is a side elevation of the electrical terminal carried by the insulating block of the assembly of FIGS. 6 and 7.

By the present invention there is carried by the insulating block 60 a generally flat, stamped terminal 66, FIG. 9, having an elongate body portion 68 and a transverse end portion 70. The end of the body portion terminates in a spade-type formation 72. The front of the insulating block 60 has a recess 74 which receives the transverse end portion 70 of the terminal 66. The arrangement is such that all portions of the transverse end portion 70 of the terminal lie below adjacent surfaces of the front of the insulating block 60, whereby if a conductive metal slug or coin were to be inadvertently inserted in the cup 12 while power is applied, the possibility of short-circuiting through the terminal end portion 70 is minimized.

In accomplishing the retention of the terminal 66 in the insulating block 60, there is preferably stamped in the terminal a sidewardly-projecting resilient spring tooth 76. By such arrangement the terminal 66 can be inserted into the through passage 64 of the insulating block 60 from the left in FIG. 13, with the tooth 76 yielding inwardly under the pressure of the walls of the passage 64 until the tooth emerges from the rear of the insulating block as in FIG. 6. The terminal 66 is thus effectively held captive in the insulating block 60 by the engagement of the end of the tooth 76 with the rear of the block 60, as in this figure.

Figure 10:
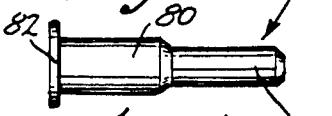
FIG. 10 is a side elevation of a modified electrical terminal adapted to be substituted for the terminal shown in FIG. 9.

As an alternative to the stamped terminal 66 illustrated in FIG. 9, by the invention provision is made for substitution of a stud 78 for use as the "hot" terminal of the outlet assembly. In accomplishing this, the centrally disposed through passage 62 of the insulating block 60 is generally cylindrical so as to mate with the cylindrical body portion 80 of the stud 78. The stud 78 is particularly illustrated in FIG. 10, and comprises in addition to the body portion 80 which is shown prior to its being knurled or ribbed, an enlarged head 82, and a connector portion 84 of reduced diameter. As noted above, the front of the insulating block 60 has a recess in which the head 82 of the stud 78 is received. As in the case of the transverse portion 70 of terminal 66, preferably the head 82 of the stud 78 lies completely below the adjacent surfaces of the front of the insulating block 60 so as to avoid the possibility of short-circuiting through the stud's head.

Figure 14:
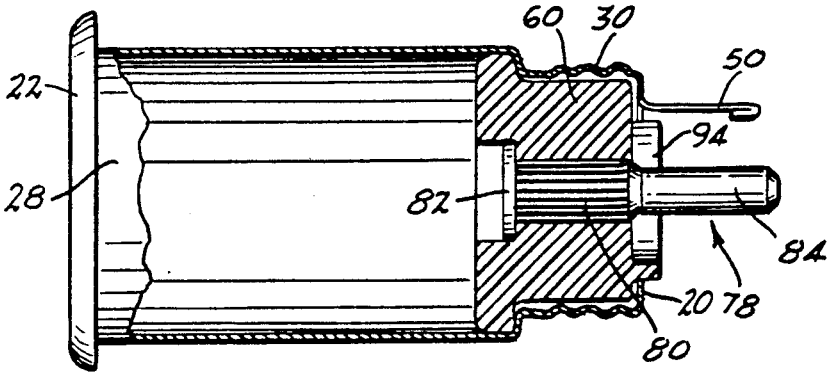
FIG. 14 is a view, partly in elevation and partly in axial section, of a modified electrical power outlet assembly incorporating the electrical terminal of FIG. 10.

It is to be understood that either the stud 78 or the strip type terminal 66 can be employed with the single insulating block 60, without modification of the latter and depending on the nature of the connections to be made to the mating receptacle (not shown) for the outlet connector. In other words, depending upon the desired type of "hot" terminal, either the stud 78 or the strip terminal 66 can be installed in the respective passage 62 or 64 of the insulating block 60. The arrangement of FIGS. 6 and 7 is intended to be used with spade-type electrical connector receptacles, whereas the arrangement of FIG. 14 would be applicable where a single spade-type electrical connector is to be used with the terminal 66 and a push-on tubular-type connector employed with the connector portion 84 of the stud 78.

Also by the invention, the insulating block 60 is mounted in the cup 12 in a unique manner. As illustrated, the cup 12 has an annular shoulder 86 intermediate its ends. The insulating block 60 has a similar annular shoulder 88, FIG. 13, and with the insulating block 60 carried in the cup 12 as shown, the two shoulders engage one another and position the block. By dimensioning the parts properly, the rear of the insulating block 60 seats against the periphery of the bottom wall 20 of the cup, which is that portion of the wall which was not blanked out during the formation of the slug 48 and terminal 50.

Figure 8:
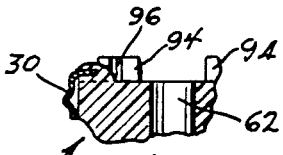
FIG. 8 is a fragmentary section taken on the line 8—8 of FIG. 7.
Figure 5:
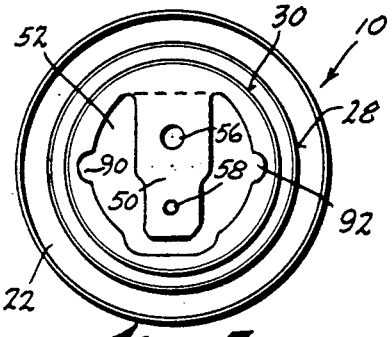
FIG. 5 is a bottom plan view of the metal cup after a spade-like terminal piece has been formed therefrom by stamping of the transverse bottom wall thereof. In the illustrated embodiment, the stamping produces a scrap metal slug having the configuration of the letter "C".

The hole 52 defined by the periphery of the bottom wall 20 is preferably provided with either one or two notches, indicated 90 and 92 in FIG. 5. In addition, the bottom of the insulating block has an integral molded skirt 94 which extends through an angle of approximately ¾ of a turn, FIGS. 7 and 12. In accomplishing the retention of the insulating block 60 in the cup 12, one or two points of the skirt 94 are engaged by an ultrasonic welding tool (not shown) which results in a heating of the skirt 94 at two localized points about the locations of the notches 90 and 92. The resulting collapsed structure at these two points constitutes depressions which are formed between the opposite walls of each notch 90 and 92. Two such depressions are indicated in FIG. 7 by the numeral 96, with one being illustrated in FIG. 8. The depressions 96 serve to key the insulating block 60 to the cup 12 and prevent relative rotation between the two parts, as well as operating to insure the retention of the insulating block 60 by the cup 12. During assembly of the outlet receptacle, the insulating block 60 can be inserted through the mouth 18 of the cup 12 and positioned with the shoulders 86, 88 in abutment with one another. The insulating block is thereby restrained against inadvertent rotation, and is also firmly held captive in the cup. It is noted that the assembly of the various components of the outlet assembly occurs from left to right in FIG. 6.

The completed power outlet assembly 10 is secured in its desired position in a hole in the dashboard or panel 24 of the vehicle or boat, after which the clamp shell 38, FIG. 6, is installed on the threaded barrel 30 of the cup 12 and tightened so as to secure the outlet in place. Electrical receptacle means are then installed on the terminals 50 and 66, or 50 and 78, and the unit is ready to be operated as soon as a male electrical plug 40, FIG. 15, is fully inserted into the cup, in the known manner.

The present outlet receptacle can be advantageously employed with literally dozens of appliances, including but not limited to auxiliary lights, power tire inflators, cooking equipment such as camper stoves or electric kitchen-type appliances, electric blankets/warmers, fans, clocks, alarms, electric shavers; household-type appliances such as vacuum cleaners, portable washers and dryers, portable dishwashers; and tools including electric drills, sanders, or saws, etc. Also, portable televisions, VCR equipment and the like, as well as a host of accessories of the kind noted above, which are of a type adapted to be operated from electrical power inverters that convert low voltage d. c. to 115 volt A. C. power.

Figure 16:
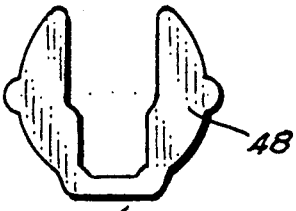
FIG. 16 is a plan view of a C-shaped slug of material which is stamped from the bottom wall of the metal cup during the formation of the integral terminal piece associated with the cup, and which slug constitutes scrap material that is to be discarded.

The invention further provides a novel method for manufacturing a socket of a power outlet assembly for an electric accessory, the outlet being of the type comprising an electrically conductive metal cup having at its mouth an out-turned flange constituting a bezel, and having at its bottom a transverse end wall. The method is illustrated in FIGS. 1, 3, 5 and 6, and comprises the steps of forming the metal cup 12 by means of a deep-drawing process employing cooperable dies 14 and 16, so as to produce an annular side body portion 28 and a bottom wall portion 30 of the metal cup, crowning the out-turned flange 22 at the mouth 18 of the metal cup 12 by means of dies 24 and 26, stamping from the bottom wall 20 of the metal cup 12, a diametric, spade-like terminal piece 50 which at one of its ends is attached to bottom wall 20 of the metal cup, with the other end of the terminal piece 50 being free and clear, and bending the terminal piece 50 adjacent its attachment, to form an outwardly-extending spade terminal piece 50, for connection to a cooperable electrical spade receptacle. During the stamping, a slug 48 constituting scrap is produced, as illustrated in FIG. 16. This is discarded, and the hole left by the slug is indicated in FIG. 5 by the numeral 52, which constitutes a clearance space in which the skirt 94 of the insulating block 60 is received, as in FIG. 6. As illustrated in FIG. 5, the stamping operation incorporates two holes 56 and 58, which can overlie one another when the terminal piece 50 is bent back upon itself as in FIG. 6, and in FIG. 5 the terminal piece 50 is seen to constitute a projection that extends into the hole 52 that was produced in the bottom wall.

The power outlet assembly as described and illustrated thus solves a number of problems associated with previous devices of this type. In particular, it is less expensive to fabricate and assemble by virtue of the novel electrical terminal configurations provided. It does not rely upon metal welded terminals, and accordingly no uncertainty exists as to possible weld integrity. As noted above, the elimination of metal welding equipment saves both manual labor and the expense of the equipment involved. The unique molded insulating block can be made so as to be universal and adaptable without modification, for use with either a stud-type hot terminal of the type illustrated in FIG. 10, or a strip-type hot terminal of the type illustrated in FIG. 9.

The device and method of the invention are thus seen to represent a distinct advance and improvement in the field of power outlet receptacles for automotive accessory equipment.

Variations and modifications are possible without departing from the spirit of the invention.

Each and every one of the appended claims defines an aspect of the invention which is separate and distinct from all others, and accordingly it is intended that each claim be treated as such when examined in the light of the prior art devices in any determination of novelty or validity.

What is claimed is:

1. A socket for an electric accessory comprising, in combination a one-piece, deep-drawn metal cup having at its mouth an integral out-turned flange constituting a bezel and having at its bottom a transverse end wall that is lanced to form a diametric, spade-like terminal piece which at one of its ends is attached to said metal cup, the other end of the terminal piece being free and clear, said terminal piece being bent outward to form an outstanding spade connector, and said metal cup having adjacent said transverse end wall an annular barrel portion the walls of which are configured to constitute a screw thread.

2. The socket as set forth in claim 1, wherein:

a) said terminal piece is integral with said metal cup at said bend.

3. The socket as set forth in claim 1, wherein:

a) said terminal piece extends rearwardly of said metal cup, and lies in a plane which is generally parallel to the axis of the metal cup.

4. The socket as set forth in claim 1, wherein:

a) said terminal piece is formed by stamping it from the bottom wall of the metal cup, said bottom wall containing a hole at the location of the terminal piece after the latter has been bent away from the wall.

5. The socket as set forth in claim 1, wherein:

a) the said other end of the terminal piece is bent back upon itself to form a double thickness of material.

6. The socket as set forth in claim 5, wherein:

a) said terminal piece has a hole extending through it for cooperation with a dimpled formation in an electrical spade receptacle.

7. The socket as set forth in claim 1, wherein:

a) said metal cup has a body portion with a substantially uniform diameter, and b) said barrel portion being characterized by a diameter which is less than that of the metal cup body portion.

8. The socket as set forth in claim 7, wherein:
a) there is formed an annular shoulder at the junction of the metal cup body portion and the barrel portion.

9. A socket for an electric accessory comprising, in combination a one-piece, deep-drawn metal cup having at its mouth an integral out-turned flange constituting a bezel and having at its bottom a transverse end wall that is lanced to form a diametric, spade-like terminal piece which at one of its ends is attached to and integral with said metal cup, the other end of the terminal piece being free and clear, said terminal piece being bent outward to form an outstanding spade connector adapted to mate with a cooperable electrical spade receptacle.

10. The socket as set forth in claim 9, wherein:
a) said terminal piece is formed by blanking out scrap material from the bottom wall, said scrap material having a generally C-shape.

11. The socket as set forth in claim 9, wherein:
a) said terminal piece is formed by blanking out scrap material from the bottom wall, said scrap material having generally the configuration of two segments of a circle.

12. An electrical power outlet assembly, comprising in combination:
a) a one-piece, deep-drawn metal cup having at its mouth an integral out-turned flange constituting a bezel and having at its bottom a transverse end wall that is lanced to form a diametric, spade-like terminal piece which at one of its ends is attached to said metal cup, the other end of the terminal piece being free and clear, said terminal piece being bent outward to form an outstanding spade connector, and said metal cup having adjacent said transverse end wall an annular barrel portion,
b) an insulating terminal block carried in said metal cup, said block having a through opening extending from its front to its rear, and
c) an electrically conductive terminal carried by said insulating block and extending completely through said through opening, said electrically conductive terminal having a forward contact portion adjacent the front of the insulating block, and a rear terminal portion extending from the rear thereof.

13. The power outlet assembly as set forth in claim 12, and further including:
a) cooperable retaining means on said metal cup and insulating block, for holding captive the latter in the metal cup.

14. The power outlet assembly as set forth in claim 12, wherein:
a) said insulating block has two through openings each extending from the front of the block to the rear thereof,
b) one opening being centrally located with respect to the axis of the metal cup, and being adapted to receive a stud,
c) the second opening being offset axially with respect to the metal cup, and being adapted to receive a substantially flat electrically conductive terminal.

15. The power outlet assembly as set forth in claim 12, wherein:
a) said metal cup has an annular positioning shoulder intermediate its ends,
b) said insulating block having a cooperable annular shoulder intermediate its ends,
c) said shoulders engaging one another so as to position the block axially within the metal cup.

16. The power outlet assembly as set forth in claim 12, and further including:
a) cooperable means on said metal cup and insulating block, for restraining the latter against rotation relative to the metal cup.

17. The power outlet assembly as set forth in claim 16, wherein:
a) said metal cup has a bottom wall with an opening formed at the location of the terminal piece,
b) said cooperable means comprises means defining a pair of notches in the opening of the bottom wall of the metal cup, and means on said insulating block, engageable with the edges of said notches, for keying the insulating block to the metal cup bottom wall.

18. The power outlet assembly as set forth in claim 16, wherein:
a) said metal cup has a bottom wall with an opening formed at the location of the terminal piece,
b) said cooperable means comprising means defining a notch in the opening of the bottom wall of the metal cup, and
c) means on said insulating block, engageable with the edges of said notch, for keying the insulating block to the metal cup bottom wall.

19. The power outlet assembly as set forth in claim 18, wherein:
a) said insulating block comprises a semi-circular flange protruding through the opening of the bottom wall of the metal cup,
b) a point on said flange being heat-fused and rolled over into said notch, so as to form a lug of insulating material occupying said notch.

20. The power outlet assembly as set forth in claim 12, wherein:
a) said insulating block has a recess in its front,
b) said electrically conductive terminal comprising a stud having a body and an enlarged head, said head being received in said recess, and the body of the stud passing through the through opening of the insulating block and projecting from the rear thereof.

21. The power outlet assembly as set forth in claim 20, wherein:
a) all portions of said head are recessed below the adjacent surfaces at the front of the insulating block.

22. The power outlet assembly as set forth in claim 20, wherein:
a) said stud has knurling on its surface, and is interlocked with the insulating block.

23. The power outlet assembly as set forth in claim 12, wherein:
a) said insulating block has a recess in its front,
b) said electrically conductive terminal having an elongate body portion which extends substantially parallel to the axis of the metal cup, and a transverse end portion which extends transverse to the axis of the metal cup,
c) said transverse end portion being nested in the recess of the insulating block.

24. The power outlet assembly as set forth in claim 23, wherein:
a) said terminal body portion and terminal end portion are integral with one another.

25. The power outlet assembly as set forth in claim 23, wherein:

a) said electrically conductive terminal is constituted as a stamped piece.

26. The power outlet assembly as set forth in claim 23, wherein:

a) said electrically conductive terminal has an elongate body portion which extends substantially parallel to the axis of the metal cup, b) said body portion having a side projection engaging the rear of the insulating block, whereby the electrically conductive terminal is held captive in said insulating block.

27. The power outlet assembly as set forth in claim 23, and further including:

a) cooperable locking means on said electrically conductive terminal and said insulating block, for retaining the terminal captive in the block.

28. The power outlet assembly as set forth in claim 27, wherein:

a) said cooperable locking means comprises a resilient tooth stamped from the electrically conductive terminal, the end of the tooth extending transversely of the terminal and being engageable with the insulating block to effect said locking.

29. The method of manufacturing a socket for an electric accessory of the type comprising an electrically conductive metal cup having an out-turned flange at its mouth constituting a bezel, and having at its bottom a transverse end wall, said method comprising the steps of:

a) forming the metal cup by means of a deep-drawing process employing cooperable dies, so as to produce an annular side body portion and a bottom wall portion of the metal cup, b) crowning the out-turned flange at the mouth of the metal cup, c) stamping from the bottom wall of the metal cup, a diametric, spade-like terminal piece which at one of its ends is attached to bottom wall of the metal cup, with the other end of the terminal piece being free and clear, and d) bending the terminal piece adjacent its attachment, to form an outwardly-extending spade connector, for connection to a cooperable electrical spade receptacle.

30. The method according to claim 29, wherein a hole is formed in the spade-like terminal simultaneously with the stamping operation.

31. The method according to claim 29, wherein a pair of holes is formed in the spade-like terminal during the stamping operation.

32. The method according to claim 29, wherein a slug of scrap material having a generally semi-circular outline is formed during the stamping operation.

33. The method according to claim 29, wherein a slug of scrap material having the configuration of the letter "C" is formed during the stamping operation.

34. The method according to claim 29, wherein an opening is punched in the bottom wall of the metal cup during the stamping operation, and wherein the spade-like terminal piece, following stamping, constitutes a projection extending into the hole.

35. The method according to claim 29, and including the further step of bending the end portion of the terminal piece back upon itself so as to form a double thickness of material.

36. The method according to claim 29, and including the further step of forming a threaded barrel portion in the side wall of the metal cup by means of rolling dies, prior to the stamping step.

* * * * *